US007290733B2

(12) United States Patent
Kamenstein et al.

(10) Patent No.: US 7,290,733 B2
(45) Date of Patent: Nov. 6, 2007

(54) DISPENSER FOR ROLLED MATERIALS

(75) Inventors: Matthew Kamenstein, Huntington, NY (US); Joel Hoag, Brooklyn, NY (US)

(73) Assignee: Lifetime Brands, Inc., Westbury, NY (US)

( * ) Notice: Subject to any disclaimer, the term of this patent is extended or adjusted under 35 U.S.C. 154(b) by 0 days.

(21) Appl. No.: 11/505,620

(22) Filed: Aug. 17, 2006

(65) Prior Publication Data

US 2007/0040059 A1 Feb. 22, 2007

Related U.S. Application Data

(63) Continuation-in-part of application No. 10/903,676, filed on Jul. 30, 2004, now Pat. No. 7,104,418, which is a continuation-in-part of application No. 10/335,420, filed on Dec. 31, 2002, now Pat. No. 6,793,097.

(51) Int. Cl.
*B65H 75/18* (2006.01)

(52) U.S. Cl. ..... 242/598.2; 242/599.3

(58) Field of Classification Search ..... 242/565, 242/598, 598.3, 598.5, 599.3, 422.4
See application file for complete search history.

(56) References Cited

U.S. PATENT DOCUMENTS

| | | | | |
|---|---|---|---|---|
| 1,762,516 | A | 6/1930 | Hlavad | |
| 2,562,923 | A | 8/1951 | Kolivoski | |
| 4,184,647 | A | 1/1980 | Rourke | |
| 4,314,678 | A * | 2/1982 | Upchurch | |
| 4,720,053 | A | 1/1988 | Vance | |
| 5,297,750 | A | 3/1994 | Hunt | |
| 5,467,935 | A * | 11/1995 | Moody | 242/422.4 |
| 5,651,487 | A | 7/1997 | Hansen | |
| 5,758,843 | A * | 6/1998 | Ongaro | 242/565 |
| 5,799,895 | A | 9/1998 | Michaud et al. | |
| 5,988,561 | A * | 11/1999 | Mele | |

(Continued)

FOREIGN PATENT DOCUMENTS

| | | |
|---|---|---|
| JP | 08 277945 | 10/1996 |

(Continued)

OTHER PUBLICATIONS

Patent Abstracts of Japan, vol. 1997, No. 02, Feb. 28, 1997 regarding JP 08 277945 A.

*Primary Examiner*—William A. Rivera
(74) *Attorney, Agent, or Firm*—Gardere Wynne Sewell LLP

(57) ABSTRACT

A dispenser for paper, plastic, foil and other goods that are supplied on rolls or tubes includes a rotation mechanism, such as a spindle, including a plurality of bows for engaging an inner surface of a roll. The spindle rotates about an end cap assembly. A mechanism provides resistance against spindle rotation about the end cap assembly. The end cap assembly is configured with an extending first shaft, aligned with an axis of rotation of the spindle, used to hang one end of the dispenser from a bracket. The dispenser further includes a spring loaded end cap including an extending second shaft, also aligned with an axis of rotation of the spindle, used to hang another end of the dispenser from the bracket. From the end cap assembly, a radially extending projection is provided. The projection includes a stop knob which functions to engage the bracket from the dispenser is hung and prevent the end cap assembly from rotating about the first and second shafts.

20 Claims, 12 Drawing Sheets

U.S. PATENT DOCUMENTS 6,056,234 A * 5/2000 Kim ..... 242/598
6,302,348 B1 10/2001 Lillelund et al.
6,357,687 B1 3/2002 Liu et al.
6,439,501 B1 * 8/2002 Harmathy ..... 242/565
6,601,790 B2 * 8/2003 Wilcox et al.
6,793,097 B2 9/2004 Kamenstein
6,923,397 B2 * 8/2005 Inana et al.
7,104,418 B2 * 9/2006 Kamenstein
2002/0070308 A1 6/2002 Fahringer
2004/0084469 A1 5/2004 Tu
2004/0124304 A1 7/2004 Kamenstein
2004/0144884 A1 7/2004 He et al.

FOREIGN PATENT DOCUMENTS

SU 880 634 A1 11/1981

* cited by examiner

DISPENSER FOR ROLLED MATERIALS

RELATED APPLICATIONS

This application is a continuation-in-part of, and incorporates by reference the entire disclosure of, U.S. patent application Ser. No. 10/903,676, filed on Jul. 30, 2004, now U.S. Pat. No. 7,104,418, which is a continuation-in-part of, and incorporates by reference the entire disclosure of, U.S. patent application Ser. No. 10/335,420, filed on Dec. 31, 2002 (now U.S. Pat. No. 6,793,097 issued Sep. 21, 2004).

BACKGROUND OF THE INVENTION

1. Technical Field of the Invention

The present invention relates in general to holders and more specifically to holders for paper, plastic, foil, tape or other goods. In particular, the present invention relates to a dispenser for paper, plastic, foil, tape or other goods that are supplied as sheets or rolls of any length and width which prevents the material from unraveling from the roll when a desired quantity is torn from the roll.

2. Description of Related Art

A number of household paper, plastic, tape and foil goods in common use are supplied as continuous sheets on rolls or tubes. The most common examples of these are paper towels, toilet paper, plastic wrap, adhesive tape and aluminum foil. In a number of cases the sheets are perforated at regular intervals to allow an individual to select a desired quantity of material and easily separate it from the roll. Dispensing of these materials is made even easier by a variety of dispensing devices that are used to mount the roll or tube on a dowel or rod to allow easy unraveling of the sheets from the roll. A drawback of most dispensers is that because the roll of product is allowed to rotate freely, the force required to separate individual sheets from the roll frequently results in excess material being unraveled from the roll.

None of the prevalent prior art solutions provide an effective means for dispensing rolled materials without unraveling excess material from the roll.

Therefore, there is a need for a dispenser for rolled products which allows only a desired quantity of the product to be unraveled.

SUMMARY OF THE INVENTION

In an embodiment of the invention, a dispenser for a product oriented on a roll comprises a first end cap assembly at one end of the dispenser and including a first shaft for hanging the first end cap assembly from a support bracket, and a second end cap assembly at an opposite end of the dispenser and including a second shaft for hanging the second end cap assembly from the support bracket. A spindle is rotatably mounted to the first end cap assembly, the spindle including a plurality of bows for engaging an inner surface of the roll and further rotating around an axis extending between the first and second shafts. A friction mechanism provides resistance to rotation of the spindle with respect to the first end cap assembly. A flange member radially extends from the first end cap assembly and a stop knob is mounted to the radially extending flange member and configured to engage the support bracket and inhibit rotation of the first end cap assembly with respect to the first shaft.

In another embodiment, a dispenser for a product oriented on a roll comprises a first end assembly of the dispenser including a first shaft for hanging the first end assembly from a support bracket, and an opposing second end assembly of the dispenser including a second shaft for hanging the second end assembly from the support bracket. A spinner engages an inner surface of the roll and is rotatably mounted to the first end assembly so as to rotate about an axis extending between the first and second shafts. A friction mechanism provides resistance to rotation of the spinner about the first end assembly. A mechanism associated with the first end assembly functions to inhibit rotation of the first end assembly with respect to the first shaft.

In accordance with another embodiment, a dispenser for a product oriented on a roll comprises a first end assembly of the dispenser including a first shaft for hanging the first end assembly from a support bracket, and an opposing second end assembly of the dispenser including a second shaft for hanging the second end assembly from the support bracket. A spindle is provided for receiving and supporting the roll, and means for providing friction resisted rotation of the spindle with respect to the first end assembly are included. A mechanism associated with the first end assembly functions to inhibit rotation of the first end assembly with respect to the first shaft.

BRIEF DESCRIPTION OF THE DRAWINGS

A more complete understanding of the dispenser of the present invention may be acquired by reference to the following Detailed Description when taken in conjunction with the accompanying Drawings wherein.

DETAILED DESCRIPTION OF THE DRAWINGS

With reference now to the drawings, and in particular to FIGS. 1A-18 thereof, embodiments of a novel rotation mechanism for a dispenser embodying the principles and concepts of the present invention will be described. While the embodiments described herein are intended as an exemplary dispenser (for paper, plastic, tape, foil), it will be appreciated by those skilled in the art that the present invention is not limited for dispensing paper, and may be employed for dispensing any sheet product supplied on rolls or tubes of any length and width.

Referring now to FIGS. 1A-4B, a first embodiment of the dispenser 100 of the present invention will be described in detail.

Figure 1A:
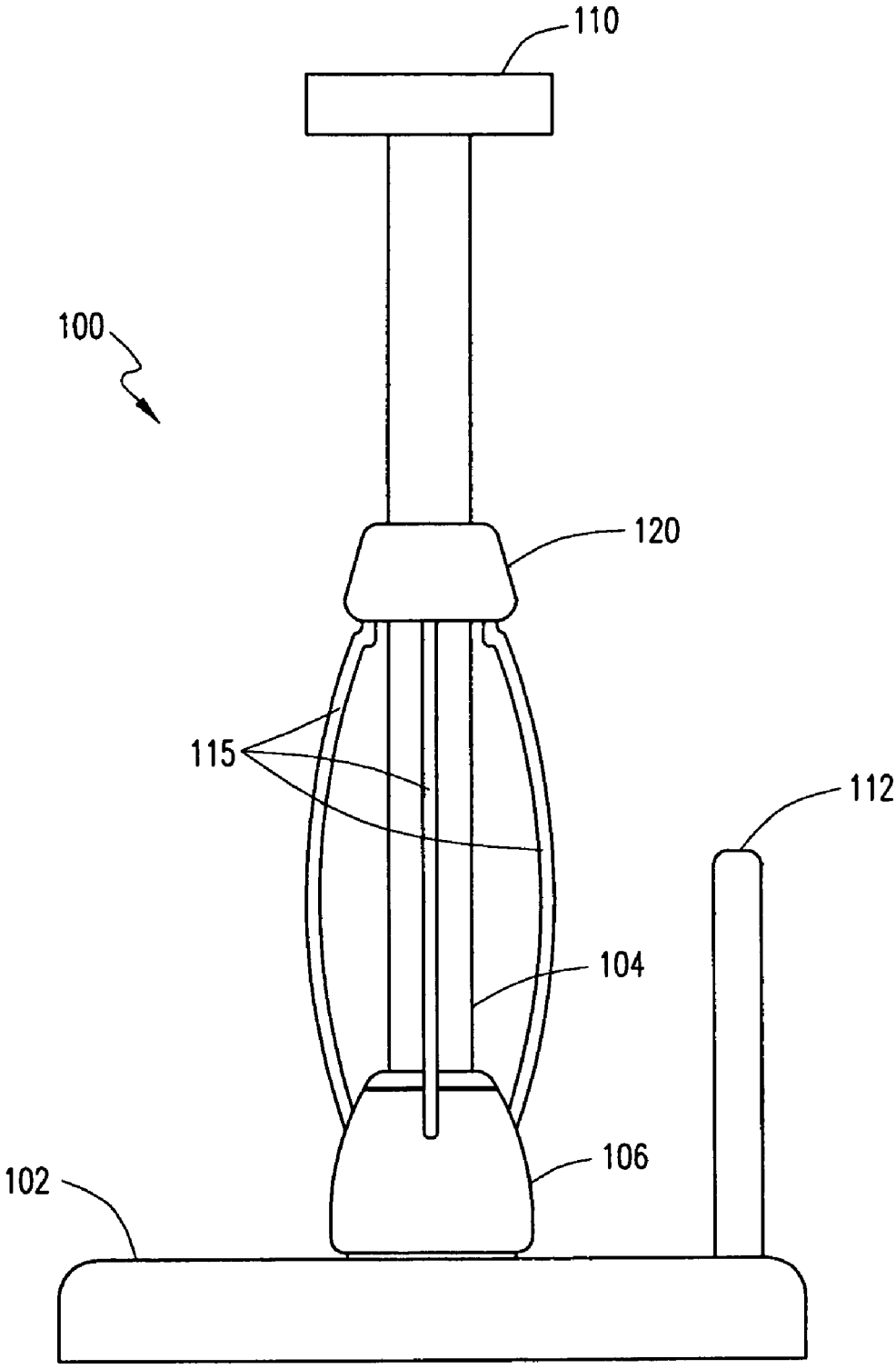
FIG. 1A is a side view of the dispenser incorporating a rotation mechanism in accordance with the present invention.

The dispenser 100 is supported by a base 102, which is preferably weighted in the embodiment shown and may include one or more suction cups. A rod 104 extends vertically from the base 102. A spinner 106 is located at one end of, and rotatable about, the rod 104, preferably proximate to the base 102 as shown in FIG. 1A. A cap 120 is located on, and rotatable about, the rod 104 towards an end opposite the spinner 106. A plurality of flexible wires 115 are connected at one end to the cap 120 and at the other end to the spinner 106. The wires 115 bow outward and may be deformable to provide a snug fit to the inside surface of a roll of sheets being dispensed (not shown). The wires 115 thus ensure that the roll, cap 120, and spinner 106 all rotate together about the rod 104 as a unit, e.g., a rotation mechanism, with no slippage of the roll with respect to the rotation mechanism.

Figure 1B:
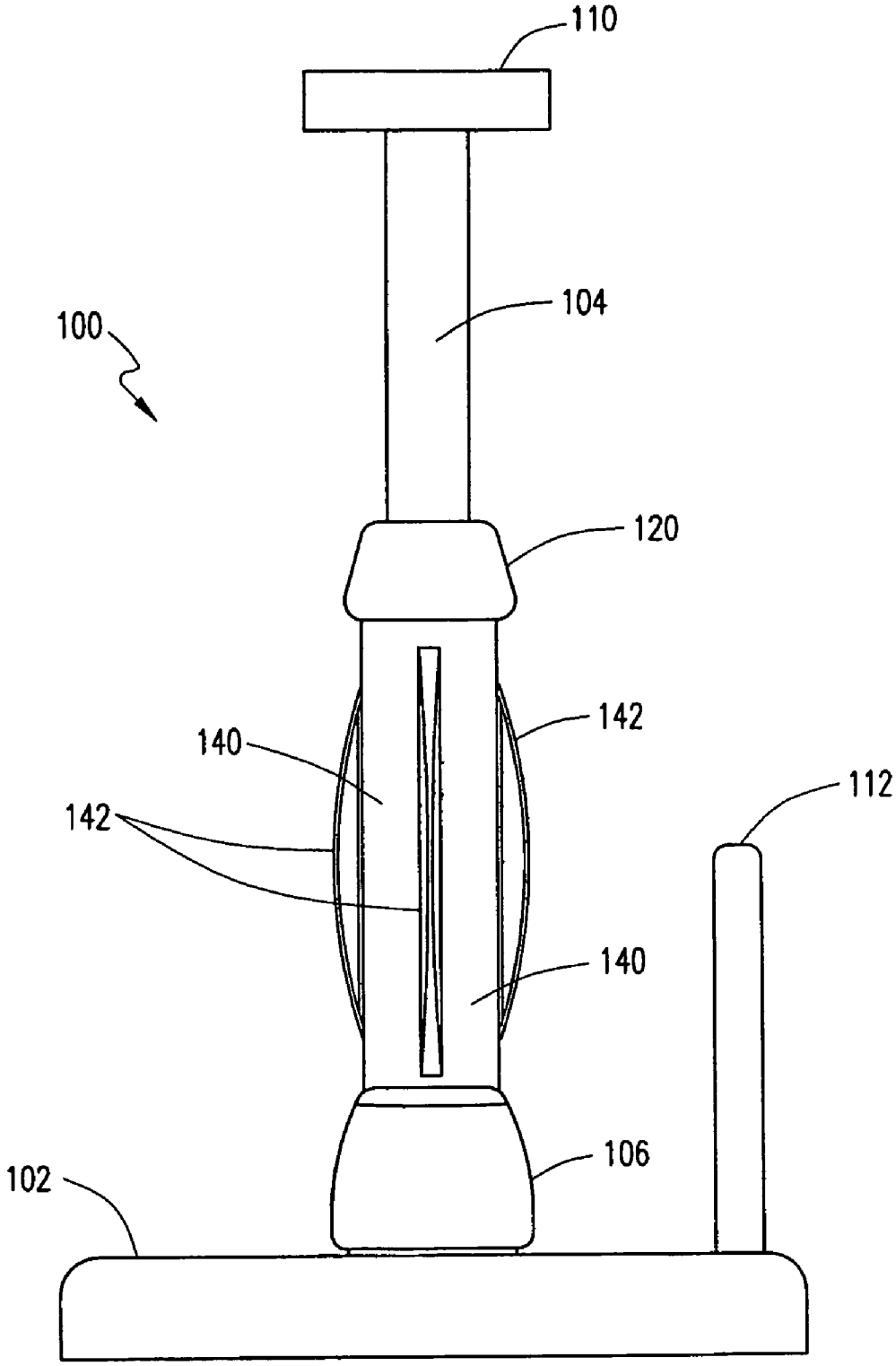
FIG. 1B is a side view of the dispenser incorporating a rotation mechanism in accordance with an alternate embodiment of the present invention.

According to an alternate embodiment of the present invention, the plurality of flexible wires 115 are replaced by a cylindrical body 140 (FIG. 1B). The cylindrical body 140 is connected at one end to the cap 120 and at the other end to the spinner 106. In an alternative implementation, the spinner 106, cap 120 and body 140 may be a unitary structure. The cylindrical body 140 includes a plurality protrusions (or bows) 142 arching outwards to perform a snug fit to the inside surface of the roll of the sheets being dispensed (not shown). The cylindrical body 140 and the protrusions 142 thus ensure that the roll, cap 120, and spinner 106 all rotate together about the cylindrical body 140 as a unit, e.g., a rotation mechanism, with no slippage of the roll with respect to the rotation mechanism.

According to an embodiment of the present invention, a tear bar 112 may be located on the base 102. The tear bar 112 acts as a support for dispensing desired quantity of material from the roll.

In yet another embodiment, a head piece 110 may be located at the end of the rod 104 opposite to the spinner 106. The head piece 110 has an outer diameter sized to fit loosely within the end of a roll or tube of the type used for paper, plastic or foil goods supplied in rolled sheets. The head piece 110 functions to stabilize the roll or tube on the rod 104 during rotation. It will be understood that in some embodiments, the cap 120 can be used in place of the head piece 110. In some embodiments, the head piece 110 may fit more snugly to the roll and may be rotatable about the rod 104.

Figure 2A:
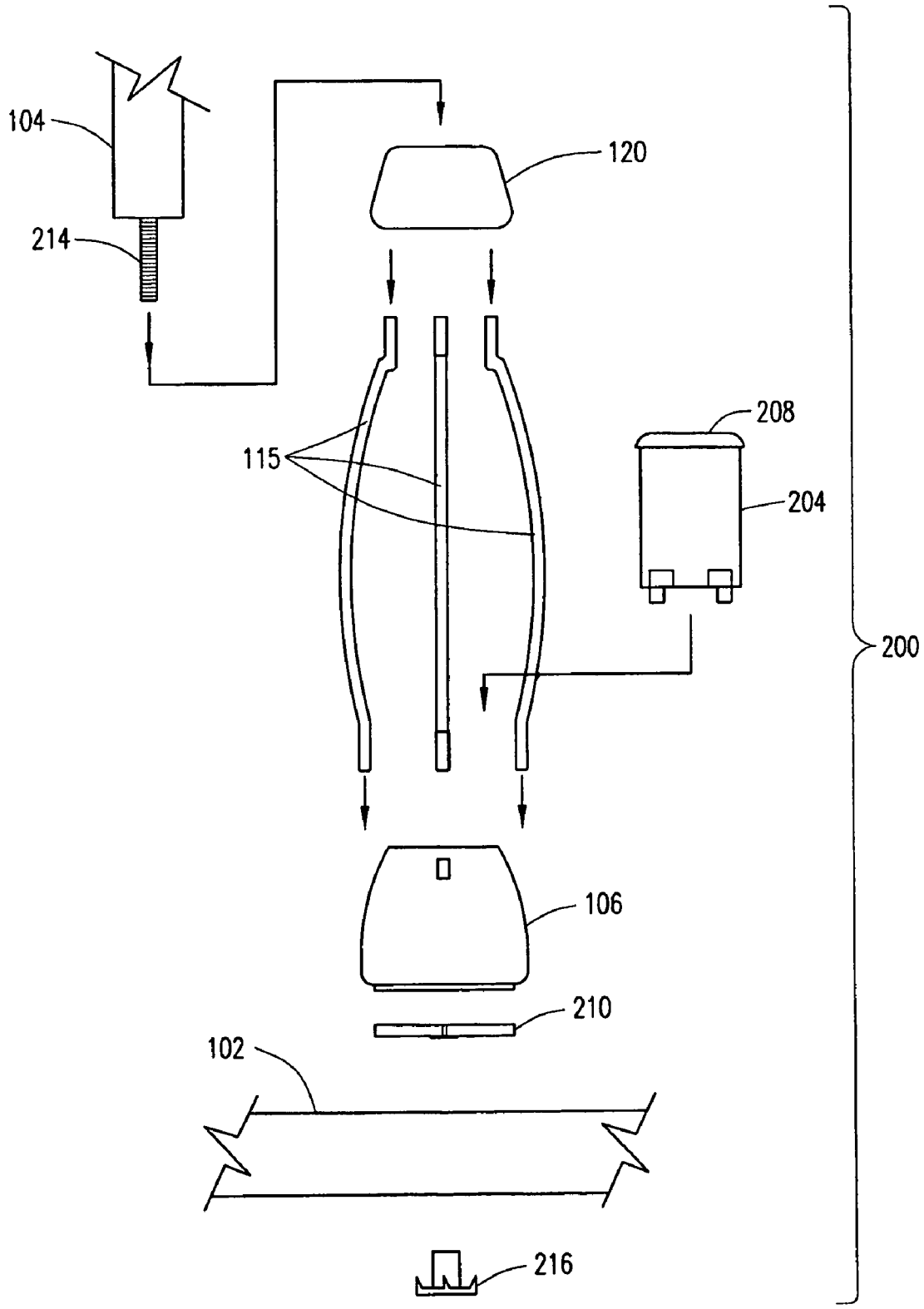
FIG. 2A is an exploded view of the rotation mechanism of FIG. 1A in accordance with the present invention.

FIG. 2A illustrates an exploded view of the rotation mechanism 200 according to an embodiment of the present invention. The rod 104 inserts through the cap 120 and into a sleeve 204. The spinner 106 is disposed on and rotatable about the sleeve 204. Preferably, a collar 208 is provided on the sleeve 204 for the purpose of retaining the spinner 106 on the sleeve 204. A friction mechanism including a friction disc 210 is disposed between the sleeve 204 and the base 102 to act upon the spinner 106. A screw stud 214 on the end of the rod 104 passes through apertures in the sleeve 204 and friction disc 210, and engages a retaining nut 216 within the base 102.

Figure 2B:
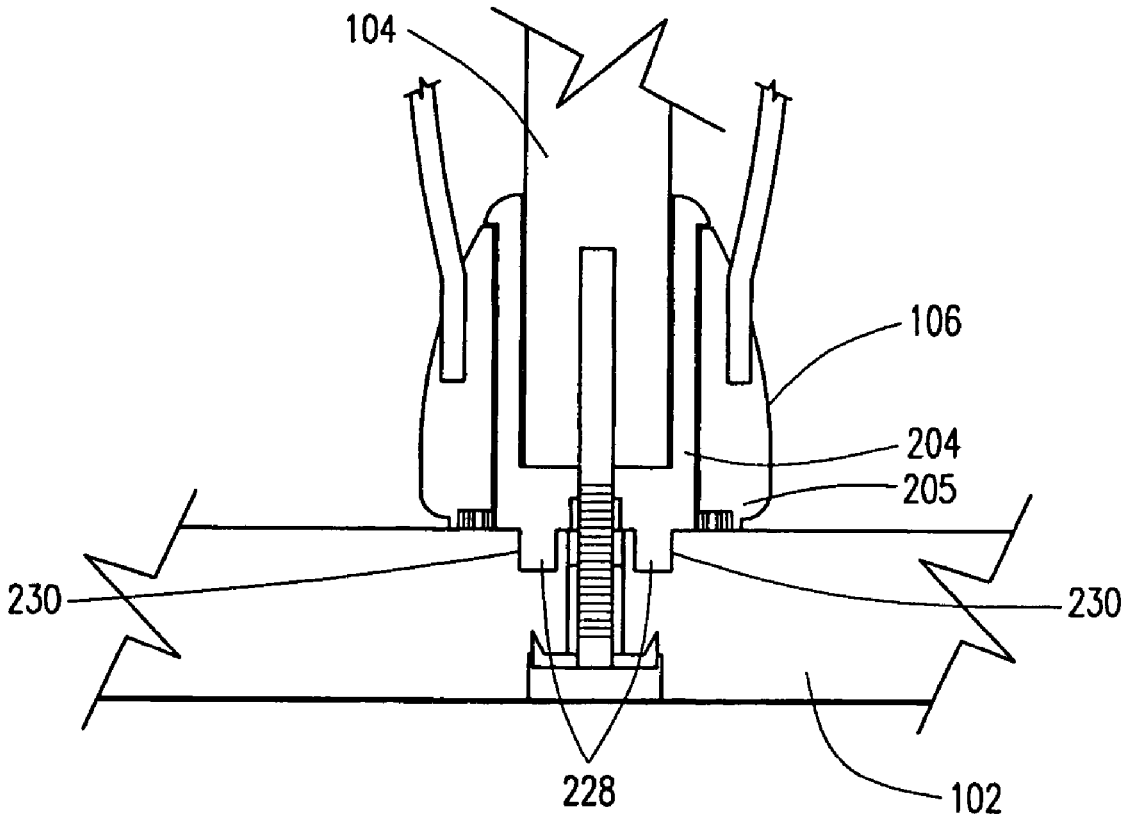
FIG. 2B is a cross-sectional view of a portion of the rotation mechanism of FIG. 1A in accordance with the present invention.

FIG. 2B illustrates a cross-sectional view of a portion of the rotation mechanism as assembled. Preferably, the sleeve 204 is provided with rotation locks 228, which engage slots 230 in the base 102, thus preventing rotation of the rod 104 and sleeve 204 as the spinner 106 rotates.

Figure 3A:
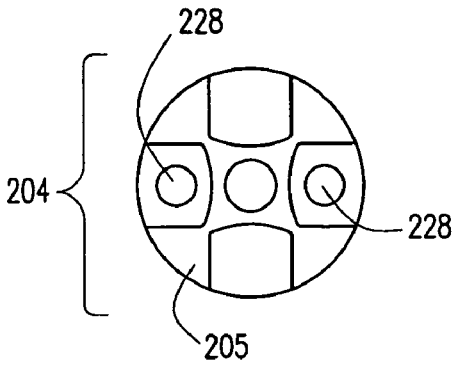
FIG. 3A is a bottom plan view of the sleeve in accordance with the present invention.

FIG. 3A illustrates a bottom plan view of the sleeve 204. The sleeve 204 has a recessed area 205 in which the friction disc 210 is situated. According to an embodiment of the present invention, the sleeve 204 can be formed from a variety of soft/hard material (such as injected molded plastic, rubber, cast alloy etc.).

Figure 3B:
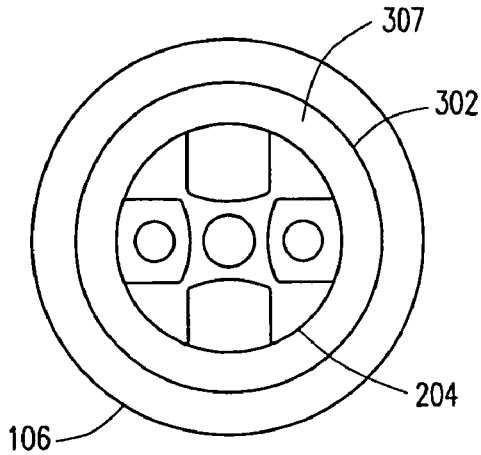
FIG. 3B is a bottom plan view of the spinner and sleeve in an assembled state in accordance with the present invention.
Figure 3C:
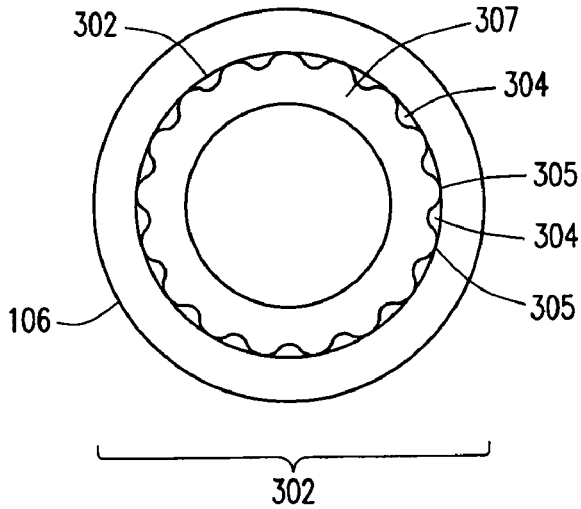
FIG. 3C illustrates the circumferential ridges in accordance with the present invention.

FIG. 3B illustrates a bottom plan view of the spinner 106 and the sleeve 204 in an assembled state. The spinner 106 is generally tubular in shape and may preferably be tapered at the head end as shown in FIGS. 2A and 2B. A concentric depression 307 is defined by the inner circumference 302. The inner circumference 302 has an undulating shape including a plurality of ridges (peaks) 304 and divots (troughs) 305 thereon. Details of the undulating inner circumference 302, as defined by the ridges 304 and divots 305, of the spinner 106 are shown in FIG. 3C. According to an embodiment of the present invention, the spinner 106 can be formed from a variety of soft/hard materials (such as injected molded plastic, rubber, cast alloy etc.).

Figure 4A:
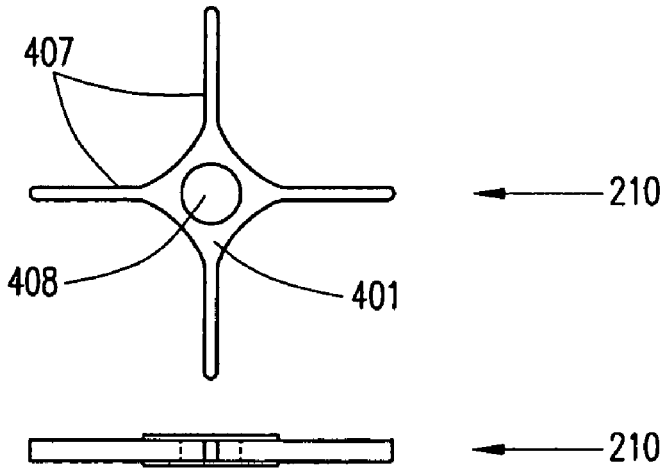
FIG. 4A is a top plan view and a side view of the friction disc according to an embodiment of the present invention.

FIG. 4A illustrates a top plan view and a side view of one embodiment for the friction disc 210. Extending from a core 401 are a plurality of flexible (spring-like) protrusions 407. A centered aperture 408 allows the passage of the screw stud 214 during assembly.

Figure 4B:
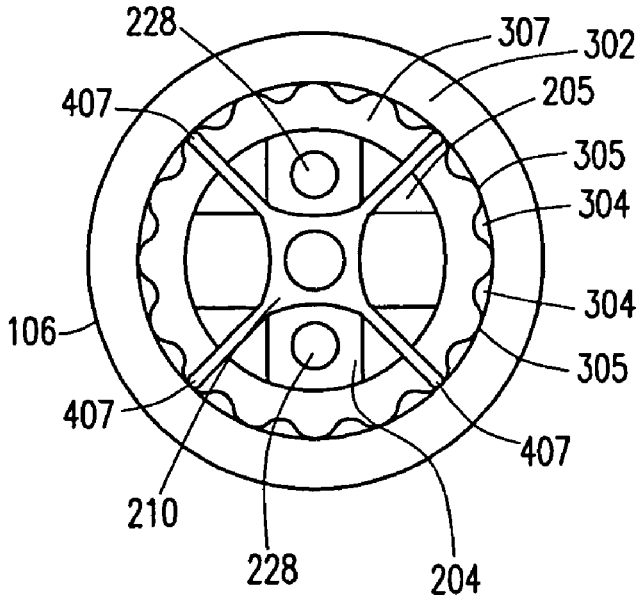
FIG. 4B is a bottom plan view of the spinner, sleeve and the friction disc in an assembled state according to an embodiment of the present invention.

FIG. 4B illustrates a bottom plan view of the spinner 106, the sleeve 204, and the friction mechanism including a friction disc 210 in an assembled state. The friction disc 210 is disposed with the protrusions 407 extending through the recessed areas 205 of the sleeve 204 and the friction disk 210 positioned in the concentric depression 307 of the spinner 106. The friction disc 210, like the sleeve 204, remains stationary as the spinner 106 rotates. In this embodiment the friction disc 210 is held stationary in the recessed areas 205 of the sleeve 204, the sleeve 204 being held stationary by the rotation locks 228. The protrusions 407 of the friction disc 210 can flex side to side in the plane of the friction disc 210 as the ridges 304 of the spinner 106 engage the ends of the protrusions 407. The protrusions 407 are sized such that they loosely engage the divots 305 between the ridges 304 in the circumference 302. As the spinner 106 rotates, the protrusions 407 ride over the ridges 304 and flex sideways thus resisting rotation. This action allows desired quantities of material to be unwound from a roll of paper, plastic, tape, foil or other rolled product. The action of the protrusions 407 alternately riding over the ridges 304 and engaging the divots 305 creates a clicking sound as the spinner 106 rotates. Once the desired quantity has been unwound, the resistance created by the engagement of the fingers in the divots 305 allows the material to be removed from a roll without undesired material coming unraveled. According to an embodiment of the present invention, the spinner 106 and the sleeve 204 can be formed from a variety of soft/hard material (such as injected molded plastic, rubber, cast alloy etc.). In addition, according to an embodiment of the present invention, either the spinner 106 or the sleeve 204 or both can be formed from a material having substantially lesser surface resistivity and material hardness than the other.

Figure 5A:
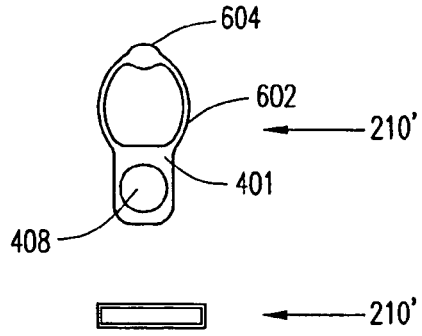
FIG. 5A is a top plan view and a side view of the friction disc according to an alternate embodiment of the present invention.

FIG. 5A illustrates an alternate embodiment of the friction disc 210' according to the present invention. The friction disc 210' comprises a loop 602 (or bow spring) extending from the core 401, while the centered aperture 408 allows the passage of the screw stud 214. A protrusion 604 extends from an outer surface of the loop 602 to engage the divots 305 between the ridges 304 in the circumference 302 (FIG. 3C).

Figure 5C:
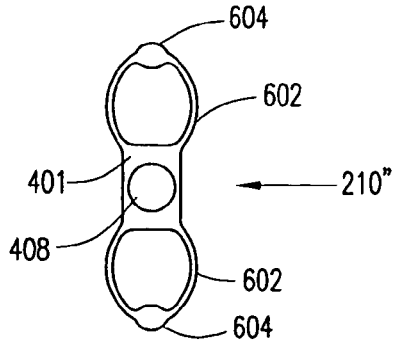
FIG. 5C is a top plan view of the friction disc according to yet another alternate embodiment of the present invention.
Figure 5B:
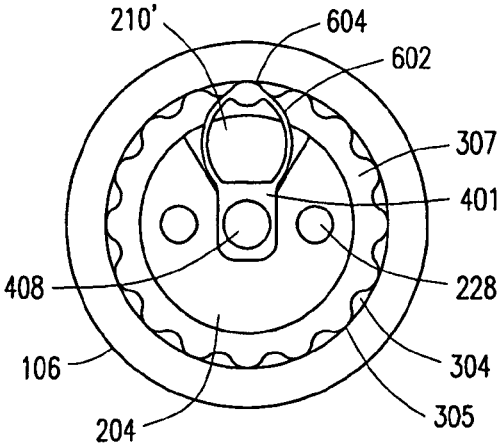
FIG. 5B is a bottom plan view of the spinner, sleeve and the friction disc in an assembled state according to an alternate embodiment of the present invention.

FIG. 5B illustrates a bottom plan view of the spinner 106, the sleeve 204, and the friction mechanism including a friction disc 210' in an assembled state. The friction disc 210' extends through the recessed areas 205 of the sleeve 204 and is positioned in the concentric depression 307 of the spinner 106. The friction disc 210', like the sleeve 204, remains stationary as the spinner 106 rotates. In this embodiment the friction disc 210' is held stationary in the recessed areas 205 of the sleeve 204, the sleeve 204 being held stationary by the rotation locks 228. The loop 602 can flex and deform as the ridges 304 (FIG. 3C) of the spinner 106 engage protrusion 604. As the spinner 106 rotates, the protrusion 604 rides over the ridges 304 thus resisting rotation. This action allows desired quantities of material to be unwound from a roll of paper, plastic, foil or other rolled product. The action of the protrusion 604 alternately riding over the ridges 304 and engaging the divots 305 creates a clicking sound as the spinner 106 rotates. The resistance created by the engagement of the protrusion 604 in the divots 305 allow the material to be removed from a roll without undesired material coming unraveled. According to an embodiment of the present invention, the spinner 106 and the sleeve 204 can be formed from a variety of soft/hard material (such as injected molded plastic, rubber, cast alloy etc.). In addition, according to an embodiment of the present invention, either the spinner 106 or the sleeve 204 or both can be formed from a material having substantially lesser surface resistivity and material hardness than the other.

FIG. 5C illustrates an alternate embodiment of the friction disc 210" according to the present invention. The friction disc 210" is substantially similar to the one disclosed earlier with respect to FIG. 5A, however, the friction disc 210" in this embodiment comprises a plurality of loops 602 extending from the core 401, while the centered aperture 408 allows the passage of the screw stud 214. A plurality of protrusions 604 extend from an outer surface of the loop 602 to engage the divots 306 between the ridges 304 in the circumference 302 (FIG. 3C).

Figure 5D:
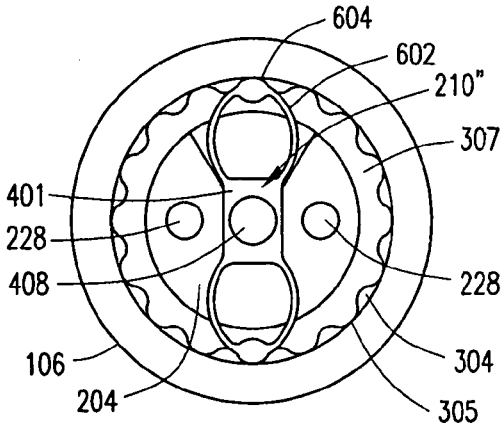
FIG. 5D is a bottom plan view of the spinner, sleeve and the friction disc in an assembled state according to an alternate embodiment of the present invention.

FIG. 5D illustrates a bottom plan view of the spinner 106, the sleeve 204, and the friction mechanism including a friction disc 210" in an assembled state. As the spinner 106 rotates, the protrusions 604 rides over the ridges 304 thus resisting rotation. This action allows desired quantities of material to be unwound from a roll of paper, plastic, foil or other rolled product. The action of the protrusions 604 alternately riding over the ridges 304 and engaging the divots 305 creates a clicking sound as the spinner 106 rotates. The resistance created by the engagement of the protrusions 604 in the divots 305 allow the material to be removed from a roll without undesired material coming unraveled. According to an embodiment of the present invention, the spinner 106 and the sleeve 204 can be formed from a variety of soft/hard material (such as injected molded plastic, rubber, cast alloy etc.). In addition, according to an embodiment of the present invention, either the spinner 106 or the sleeve 204 or both can be formed from a material having substantially lesser surface resistivity and material hardness than the other.

Figure 5E:
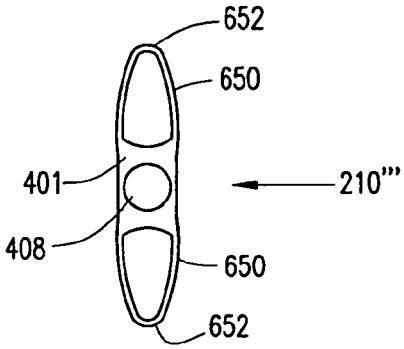
FIG. 5E is a top plan view of the friction disc according to yet another alternate embodiment of the present invention.

FIG. 5E-*illustrates* an alternate embodiment of the friction disc 210'" according to the present invention. The friction disc 210'" comprises a plurality of elongated loops (bow springs) 650 extending from the core 401, while the centered aperture 408 allows the passage of the screw stud 214. A plurality of circular edges 652 extend from an outer surface of the loops 650 to engage the divots 306 between the ridges 304 in the circumference 302 (FIG. 3C).

Figure 5F:
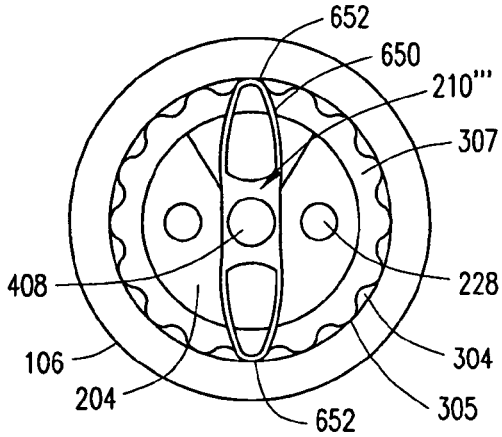
FIG. 5F is a bottom plan view of the spinner, sleeve and the friction disc in an assembled state according to an alternate embodiment of the present invention.

FIG. 5F illustrates a bottom plan view of the spinner 106, the sleeve 204, and the friction mechanism including a friction disc 210'" in an assembled state.

Figure 6A:
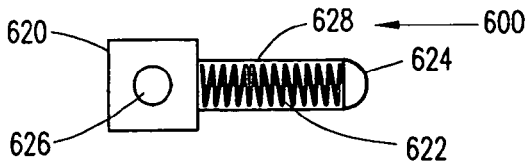
FIG. 6A is a top plan view of the friction mechanism according to yet another alternate embodiment of the present invention.

FIG. 6A illustrates a top plan view of an alternate embodiment of the friction mechanism 600 according to the present invention. The friction mechanism 600 includes a hub 620, a spring mechanism 622 and a plunger 624. Extending from the hub 620 in a shaft 628 is the spring mechanism 622, which includes the plunger 624 attached to an end of the spring mechanism 622. A centered aperture 626 allows the passage of the screw stud 214. According to an embodiment of the invention, the plunger can be made of rubber, plastic, metal, etc.

Figure 6C:
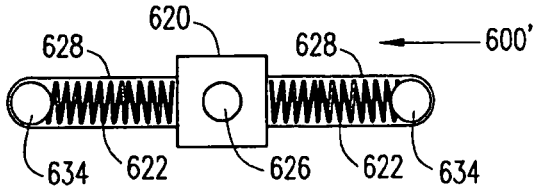
FIG. 6C is a top plan view of the friction mechanism according to yet another alternate embodiment of the present invention.
Figure 6B:
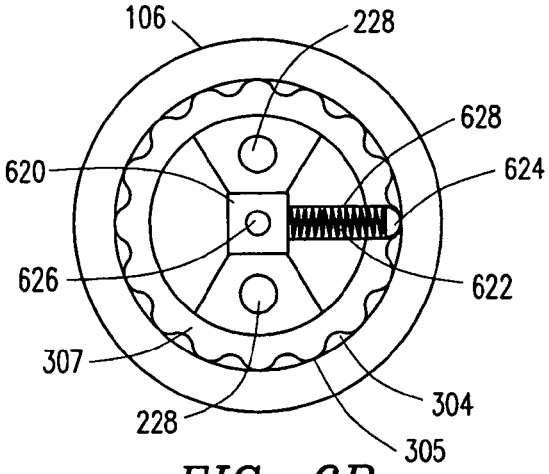
FIG. 6B is a bottom plan view of the spinner, sleeve and the friction mechanism in an assembled state according to an alternate embodiment of the present invention.

FIG. 6B illustrates a bottom plan view of the spinner 106, the sleeve 204, and the friction mechanism 600 (as shown in FIG. 6A) in an assembled state. The spring mechanism 622 extends through the recessed area 205 of the sleeve 204 and is positioned in the concentric depression 307 of the spinner 106. In this embodiment the hub 620 of the friction mechanism 600 is held stationary by the screw stud 214, while the sleeve 204 is held stationary by the rotation locks 228. The spring mechanism 622 can compress in the plane of the friction mechanism 600 within the shaft 628 as the ridges 304 (FIG. 3C) of the spinner 106 engage the plunger 624 of the spring mechanism 622. The spring mechanism 622 decompresses in the shaft 628 to loosely engage the divots 305 between the ridges 304 in the circumference 302. As the spinner 106 rotates, the spring mechanism 622 compresses and decompresses as the plunger 624 rides over the ridges 304 and divots 305 thus resisting rotation. This action allows desired quantities of material to be unwound from a roll of paper, plastic, tape, foil, or other rolled product. The action of the plunger 624 alternately riding over the ridges 304 and engaging the divots 305 creates resistance as the spinner 106 rotates. The resistance created by the engagement of the plunger 624 in the divots 305 allows the material to be removed from a roll without undesired material coming unraveled. According to an embodiment of the present invention, the spinner 106 and the sleeve 204 can be formed from a variety of soft/hard material (such as injected molded plastic, rubber, cast alloy etc.). In addition, according to an embodiment of the present invention, either the spinner 106 or the sleeve 204 or both can be formed from a material having substantially lesser surface resistivity and material hardness than the other.

FIG. 6C illustrates a top plan view of an alternate embodiment of the friction mechanism 600' according to the present invention. The friction mechanism 600' is substantially similar to the one disclosed earlier with respect to FIG. 6A, however, the friction mechanism 600' in this embodiment comprises a plurality spring mechanisms. In addition, the plunger 624 attached to the end of the spring mechanism 622 (FIG. 6A) can be replaced by a spring loaded ball bearing 634 attached to each end of the spring mechanism 622.

Figure 6D:
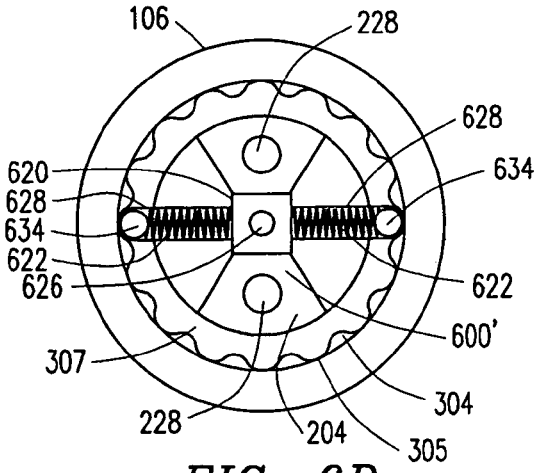
FIG. 6D is a bottom plan view of the spinner, sleeve and the friction mechanism in an assembled state according to an alternate embodiment of the present invention.

FIG. 6D illustrates a bottom plan view of the spinner 106, the sleeve 204, and the friction mechanism 600' (as shown in FIG. 6C)in an assembled state. The spring mechanisms 622 extend through the recessed area 205 of the sleeve 204 and are positioned in the concentric depression 307 of the spinner 106. In this embodiment the hub 620 of the friction mechanism 600' is held stationary by the screw stud 214, while the sleeve 204 is held stationary by the rotation locks 228. The spring mechanisms 622 can compress in the plane of the friction mechanism 600' within the shafts 628 as the ridges 304 (FIG. 3C) of the spinner 106 engage the plunger 624 of the spring mechanisms 622. The spring mechanisms 622 decompress in the shafts 628 to loosely engage the divots 305 between the ridges 304 in the circumference 302 thus resisting rotation. As the spinner 106 rotates, the spring mechanisms 622 compress and decompress as the ball bearings 634 ride over the ridges 304 and divots 305. This action allows desired quantities of material to be unwound from a roll of paper, plastic, tape, foil, or other rolled product. The action of the ball bearings 634 alternately riding over the ridges 304 and engaging the divots 305 creates resistance as the spinner 106 rotates. The resistance created by the engagement of the ball bearings 634 in the divots 305 allows the material to be removed from a roll without undesired material coming unraveled. According to an embodiment of the present invention, the spinner 106 and the sleeve 204 can be formed from a variety of soft/hard material (such as injected molded plastic, rubber, cast alloy etc.). In addition, according to an embodiment of the present invention, either the spinner 106 or the sleeve 204 or both can be formed from a material having substantially lesser surface resistivity and material hardness than the other.

In another embodiment of the, the plurality of ball bearings 634 can be replaced by a plurality of plungers 624 (FIG. 6A).

Figure 6E:
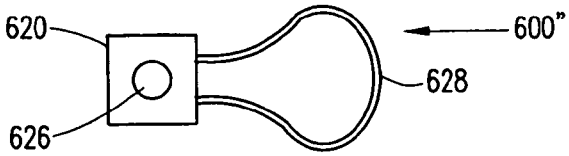
FIG. 6E is a top plan view of the friction mechanism according to yet another alternate embodiment of the present invention.

In yet another alternate embodiment, the friction mechanism 600" comprises a circular loop (bow spring) 628 extending from the hub 620, while the centered aperture 626 allows the passage of the screw stud 214 (FIG. 6E). This friction mechanism 600" is assembled for operation in a manner similar to that shown in FIGS. 6A and 6C.

Figure 6F:
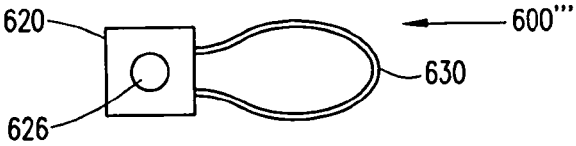
FIG. 6F is a top plan view of the friction mechanism according to yet another alternate embodiment of the present invention.

In yet another alternate embodiment, the friction mechanism 600'" comprises an elongated loop (bow spring) 630 extending from the hub 620, while the centered aperture 626 allows the passage of the screw stud 214 (FIG. 6F). This friction mechanism 600'" is assembled for operation in a manner similar to that shown in FIGS. 6A and 6C.

Figure 7A:
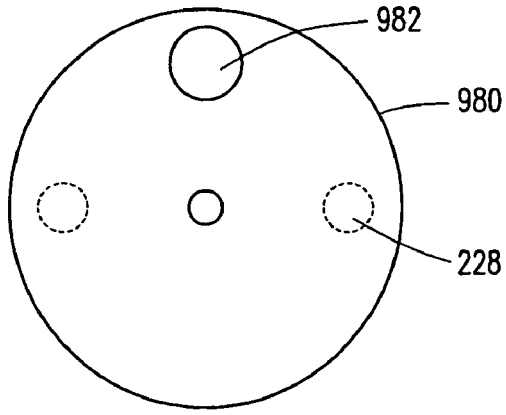
FIG. 7A is a top plan view of the sleeve in accordance with an alternate embodiment of the present invention.

FIG. 7A illustrates a top view of an alternative embodiment of the sleeve 204 according to the present invention. The sleeve 204 is substantially solid and generally circular and disc-like in shape and comprises a smooth outer circumference 980. Mounted within the sleeve 204 near the circumference 980 is a vertical cylindrical channel retaining a spring loaded ball bearing 982 (see, also, FIG. 7C). The spring loaded ball bearing 982 acts as a source of friction as will be described.

Figure 7B:
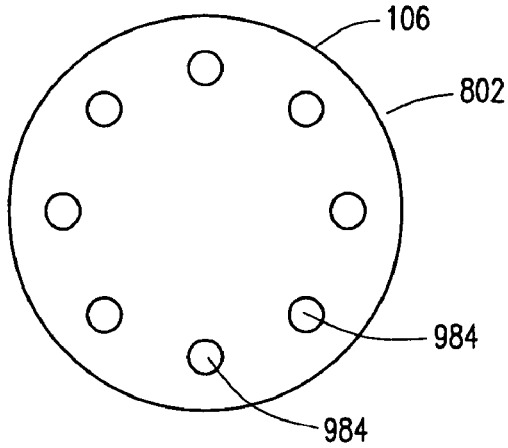
FIG. 7B is a bottom plan view of the spinner in accordance with an alternate embodiment of the present invention.

FIG. 7B illustrates a bottom view of an alternative embodiment of the spinner 106 according to the present invention. The spinner 106 is substantially solid and generally circular and disc-like in shape and comprises a smooth outer circumference 802. The circumference 802 may be slightly larger than the circumference 980. A bottom surface of the spinner 106, comprises a plurality of detents 984 arranged about the circumference 802 which are sized and shaped to receive and engage a surface of the spring loaded ball bearing 982 (FIG. 7A).

Figure 7C:
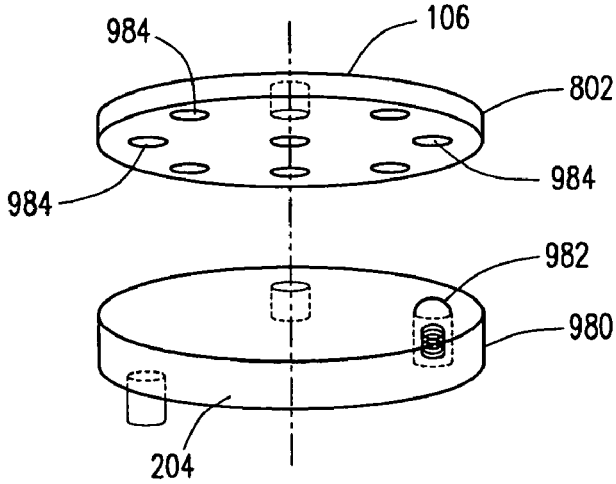
FIG. 7C is an exploded perspective view of the spinner and the sleeve according to yet another alternate embodiment of the present invention.

FIG. 7C illustrates a disassembled perspective view of the spinner 106 (FIG. 7B) and the sleeve 204 (FIG. 7A). In this embodiment, the sleeve 204 is held stationary by the rotation locks 228 (and passage of the rod 104). The spring loaded ball bearing 982 (FIG. 7A) engages the plurality of detents 984 (FIG. 7B) as the spinner 106 rotates. The detents 984 are sized such that they loosely engage the spring loaded ball bearing 982. As the spinner 106 rotates, the spring loaded ball bearing 982 creates a resistive holding force when the detents 984 on the bottom surface of the spinner 106 rotate into position to engage the ball bearing 982. This allows a desired quantity of material to be unwound from a roll of paper, plastic, tape, foil or other rolled product. The resistance created by the ball bearing 982 movement into and out of the detents 984 on the surface of the spinner 106 allows the material to be removed from a roll without undesired material coming unraveled.

Figure 8:
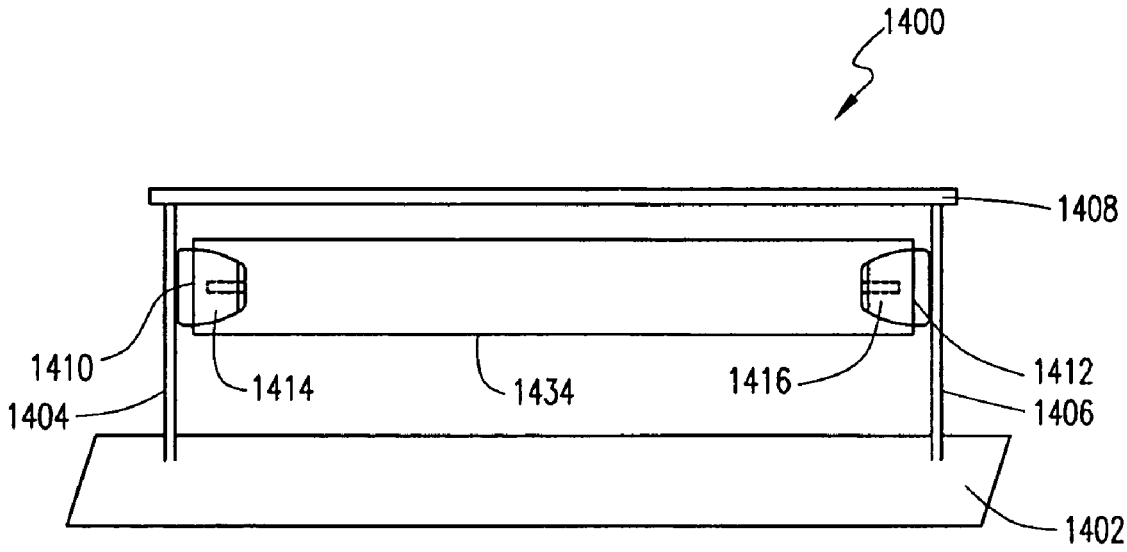
FIG. 8 is a side view of the dispenser incorporating a plurality of rotation mechanisms in accordance with an alternate embodiment of the present invention.

FIG. 8 depicts a side view of the dispenser 1400 according to another embodiment of the present invention. The dispenser 1400 is supported by a base 1402, which is preferably weighted in the embodiment shown and may include one or more suction cups. A plurality of bars 1404 and 1406 extend vertically from either end of the base 1402. A head piece 1408 may be located towards the ends of the vertical bars 1404 and 1406 opposite to the base 1402. The head piece 1408 functions to stabilize the roll or tube 1434 during rotation. The head piece 1408 can also function as a tear bar. It will be understood that in some embodiments, the head piece 1408 can be eliminated.

A first spinner/sleeve 1410 is located at a location on the vertical bar 1404. A second spinner/sleeve 1412 is located at a location on the vertical bar 1406 such that the first spinner 1410 and the second spinner 1412 are substantially at the same height. According to embodiments of the present invention, the spinners/sleeves 1410 and 1412 are configured like the spinners/sleeves disclosed earlier with respect to FIGS. 2A-7C. A first rod 1414 extends horizontally outwards from the vertical bar 1404 in the direction of vertical bar 1406. A second rod 1416 extends horizontally outwards from the vertical bar 1406 in the direction of vertical bar 1404. The first rod 1414 inserts into the first spinner/sleeve 1410 similar to the configuration of rod 104 disclosed earlier with respect to FIG. 2A. The second rod 1416 inserts into the second spinner/sleeve 1412 similar to the configuration of rod 104 disclosed earlier with respect to FIG. 2A. The spinners 1410 and 1412 and the roll rotate together about the rods 1414 and 1416 as a unit, e.g., a rotation mechanism, with no slippage of the roll with respect to the rotation mechanism.

Figure 9:
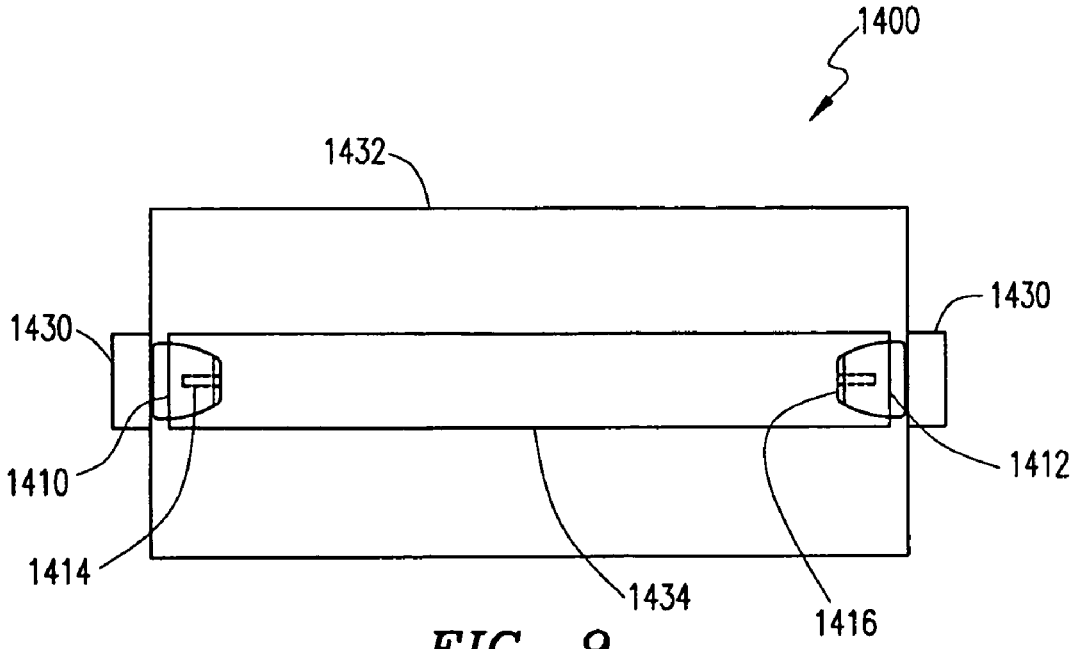
FIG. 9 is a side view of the dispenser mounted horizontally and incorporating a plurality of rotation mechanisms according to an alternate embodiment of the present invention.

Referring to FIG. 9, an alternate embodiment of the dispenser 1400 suitable for mounting horizontally on a wall is shown. A base 1430 allows the horizontal mounting. Also shown is a roll of material to be dispensed 1432 wrapped on a tube 1434 and positioned on the dispenser 1400.

Referring now to FIGS. 10-18, an embodiment of the dispenser of the present invention tailored more particularly to toilet paper dispensing (but useful in dispensing other products) will be described in detail.

Figure 10:
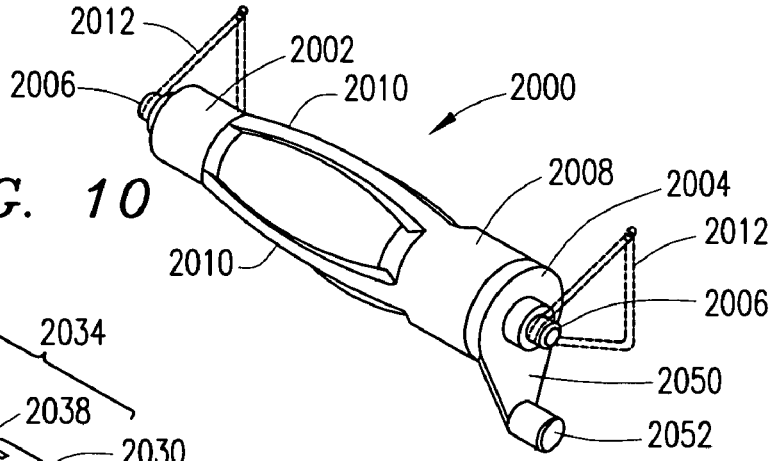
FIG. 10 shows an orthogonal perspective view of a toilet paper dispenser.

FIG. 10 shows an orthogonal perspective view of a toilet paper dispenser 2000. The dispenser 2000 includes a first end cap 2002 and a second end cap 2004. Each end cap 2002/2004 includes a small diameter shaft 2006 sized and shaped to be received in opposed openings of a toilet paper dispenser support assembly (or bracket) 2012 (shown in phantom) known to those skilled in the art. As will be discussed in greater detail herein, the end cap 2002 is spring-loaded with respect to the end cap 2004 thus allowing for an overall length of the dispenser 2000 to be compressed/shortened when installing the dispenser onto the toilet paper dispenser support assembly 2012. The dispenser 2000 further includes a rotatable spindle (spinner) 2008 which is capable of spinning about a central axis (2042, see FIGS. 11A and 11B) of the dispenser while the end caps 2002/2004 remain stationary (i.e., the spindle rotates about or with respect to one or both of the end caps 2002/2204). The central axis of rotation is defined as extending between and in alignment with the opposed small diameter shafts 2006 on the caps 2002/2004. The spindle 2008 includes a plurality of bows 2010 which are deformable and are sized and shaped to provide a snug fit to an inside surface of a roll of toilet paper being dispensed (not shown). The bows 2010 thus ensure that the toilet paper roll and spindle 2008 all rotate together about the axis as a unit with no slippage of the roll with respect to the spindle 2008. The spindle may have a configuration as shown in FIGS. 1A and 1B as described above.

Figure 11A:
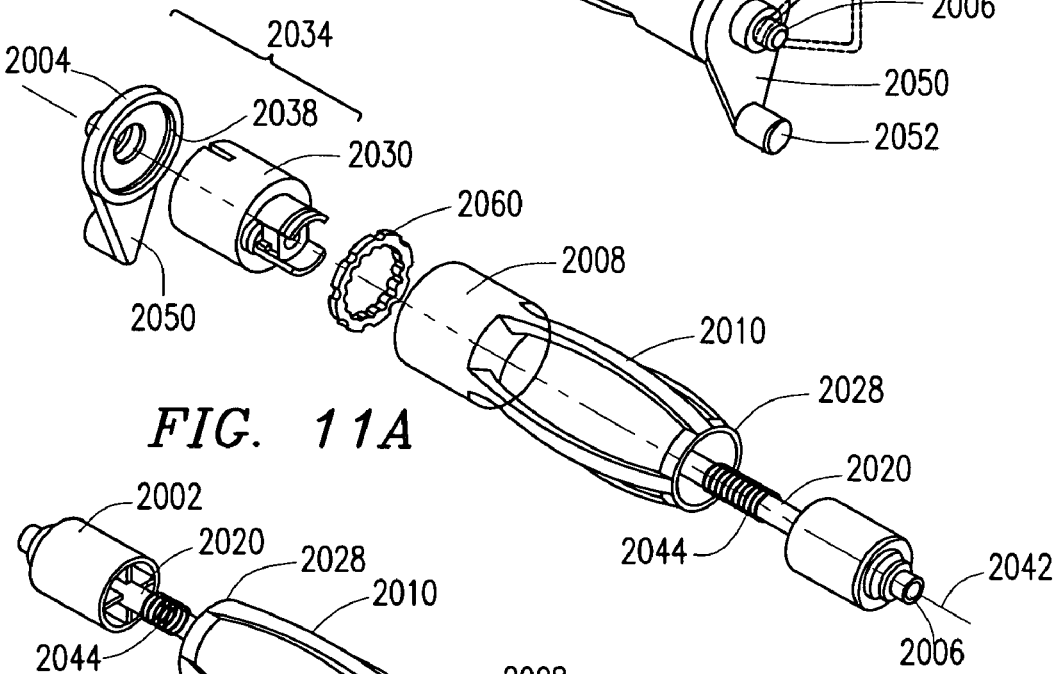
FIGS. 11A and 11B show opposite exploded orthogonal perspective views of the toilet paper dispenser.
Figure 11B:
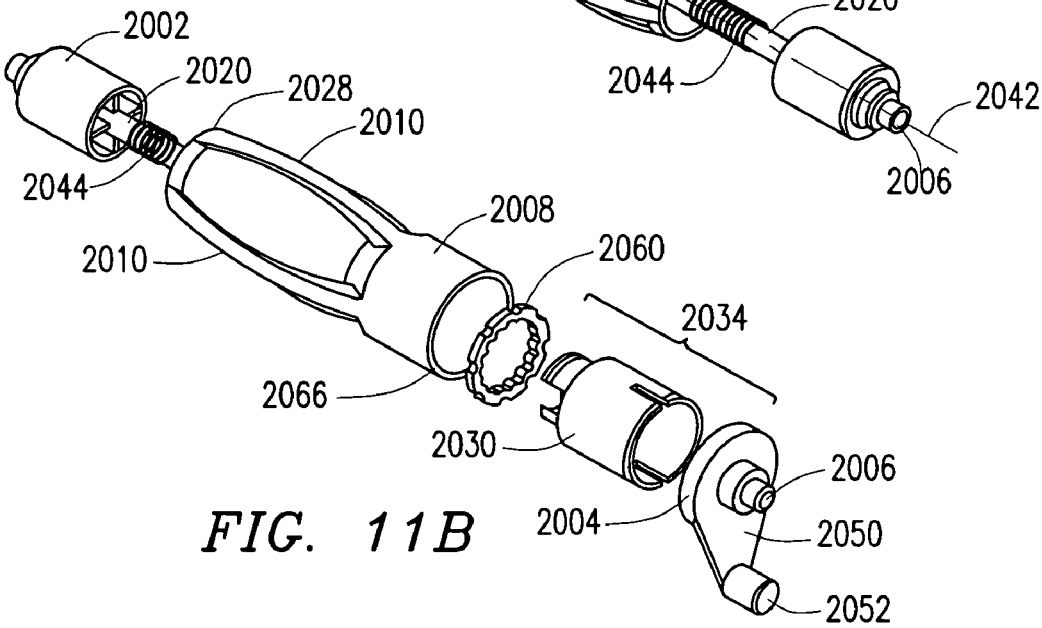
Figure 12:
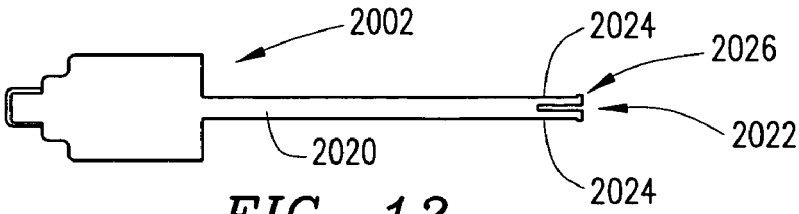
FIG. 12 shows a side view of one end cap.

FIGS. 11A and 11B show opposite exploded orthogonal perspective views of the toilet paper dispenser 2000. The end cap 2002, which is shown in a side view in FIG. 12, is an assembly which includes an extending shaft 2020. At a distal end 2022 of the shaft 2020, the shaft splits into a pair of finger members 2024, with each finger member 2024 terminated on an outer surface thereof with a barb 2026. The end cap 2002, near the shaft 2006, is cylindrically-shaped. A first end 2028 of the spindle 2008 is also cylindrically-shaped. The end cap 2002 has an outer diameter of its cylindrically-shaped portion that is sized to be slightly smaller than an inner diameter of the cylindrically-shaped portion at the first end 2028 of the spindle 2008. This allows the end cap 2002 to be inserted into and be received by the first end 2028 of the spindle 2008 during assembly and when pressure is applied to the spring loaded end cap 2002 and the dispenser is compressed/shortened during dispenser installation.

Figure 13:
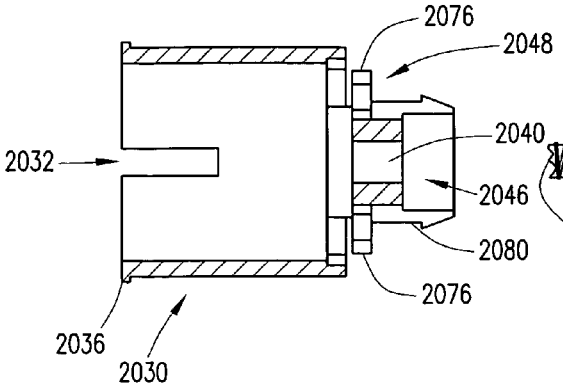
FIG. 13 shows a cross-section of an internal roller.
Figure 14:
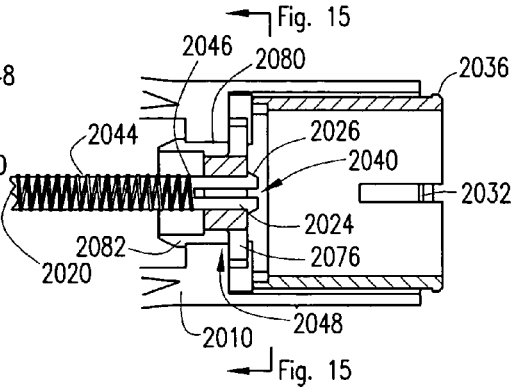
FIG. 14 shows a partial assembled cross-sectional view of the internal roller.
Figure 15:
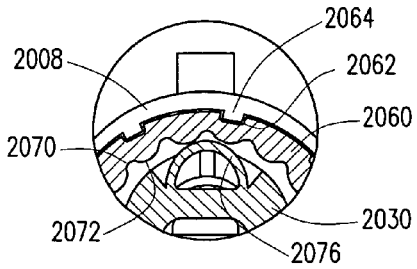
FIG. 15 shows a partial assembled end view of the undulating ring and internal roller configuration.
Figure 17:
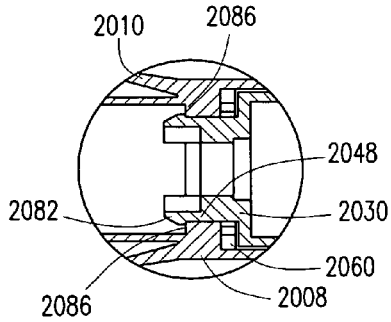
FIG. 17 shows a partial assembled cross-section view of the spindle and internal roller.
Figure 16:
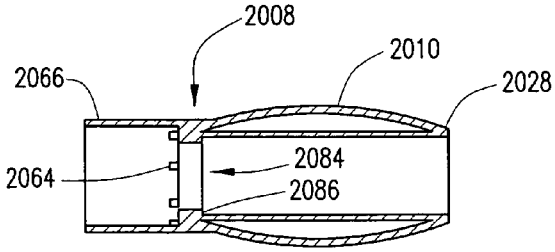
FIG. 16 shows a cross-section of a spindle.

An internal roller 2030, shown in cross-section in FIG. 13, is snap-assembled to the end cap 2004 to form an end cap assembly 2034. A peripheral ridge 2036 about an outer surface circumference of the internal roller 2030 engages and is retained by a complementary groove 2038 in an inner surface circumference of the end cap 2004. Slots 2032 in the internal roller 2030 allow for material deformation of the internal roller 2030 which facilitates attachment to the end cap 2004.

The internal roller 2030 includes a central opening 2040 which receives the distal end 2022 of the shaft 2020. More particularly, the opening 2040 receives the compressed pair of finger members 2024 during assembly and engages the barb 2026 thus preventing disassembly (see, FIG. 14). The opening 2040 does, however, allow for slidable movement of the shaft 2020 along the axis 2042 in support of allowing for an overall length of the dispenser 2000 to be compressed/shortened when installing the dispenser onto the toilet paper dispenser support assembly 2012. A spring 2044 is provided over the shaft 2020 to resist compression/shortening of the overall length of the dispenser 2000. One end of the spring 2044 engages the cylindrically-shaped portion of the end cap 2002 opposite the distal end 2026 of the shaft 2020, while an opposite end of the spring 2044 engages a seat 2046 in a neck portion 2048 of the internal roller 2030. The spring 2044 biases the end cap 2002 away from the end cap assembly 2034.

The end cap 2004 includes a radially extending flange member 2050, wherein radially extending refers to extending in a radial direction away from the axis 2042. The flange member 2050 terminates at a distal end and includes a perpendicularly extending stop knob 2052. The stop knob 2052 extends in a direction parallel to, but radially offset from, the axis 2042. When the dispenser 2000 is installed onto the toilet paper dispenser support assembly 2012, the stop knob 2052 of the second end cap 2004 functions to engage its corresponding end of the toilet paper dispenser support assembly 2012 (for example, on an edge thereof) and thus prevent rotation of the second end cap 2004 about the axis (i.e., with respect to the shaft 2006). As will be discussed in more detail below, with the second end cap 2004 (and thus the assembly 2034) inhibited from rotating about the axis 2042 by the stop knob 2052, the only part of the dispenser 2000 which is then allowed to rotate is the spindle 2008 which supports the roll of toilet paper.

It will be understood that the use of the stop knob is optional as alternatively the radially extending flange member 2050 could sufficiently contact the support assembly 2012 or a wall to which it is attached in order to inhibit rotation of the end cap assembly 2034 (i.e., end cap 2004) about the axis 2042.

The dispenser 2000 further includes an undulating ring 2060. The ring 2060 includes an outer diameter surface including a plurality of channels 2062 which engage correspondingly positioned ridges 2064 located on an inner diameter surface of a second end 2066 of the spindle 2010. The interaction of the channels 2062 and ridges 2064 prevent the ring 2060 from being able to rotate independent of the spindle 2010. Thus, as the spindle 2010 rotates about the axis 2042, the undulating ring 2060 will also coaxially rotate.

The ring 2060 further includes an inner diameter surface with an undulating shape which includes a plurality of peaks 2072 and troughs 2070. See, also, FIGS. 3C, 4B, 5B, 5D, 5F, 6B and 6D. The internal roller 2030 includes a pair of opposed bow springs 2076 which are curved to engage the inner diameter surface of the ring 2060. See, also, FIGS. 4A, 5A, 5C, 5E, 6E and 6F. More specifically, the bow springs 2076 are resilient and are configured to engage troughs 2070 of the ring 2060 when in their relaxed spring condition. As the ring 2060 (along with the spindle) rotates about the axis 2042, the peaks 2072 cause the resilient bow springs 2076 to be compressed. The peaks 2072 of the undulating shape, in conjunction with the bow springs 2076, act to inhibit rotation about the axis 2042, or also to stop further rotation about the axis 2042.

It will be understood that the friction mechanism or means formed by the spring 2076 and undulating ring 2060 is just one possible implementation. Alternatively, the friction mechanism or means may utilize any of the configurations shown in FIGS. 3A to 7C.

The neck portion 2048 of the internal roller 2030 has a cylindrical shape and functions as a bearing about which the spindle 2008 is allowed to rotate (subject to rotation friction control exercised by the bow springs 2076 and undulating shape of the ring 2060 or the friction mechanism as discussed above). A pair of opposed fingers 2080 axially extending along the neck portion 2048 terminate at radially extending barbs 2082. An outer diameter of the neck portion 2048 is sized slightly smaller than an inner diameter of the central bore 2084 in the spindle 2008 (see, FIG. 16). When the second end 2066 of the spindle 2008 receives the internal roller 2030, the neck portion 2048 passes through the central bore 2084 (see, FIG. 17). When fully received within the end 2066 of the spindle 2008, the opposed fingers 2080 rotatably support the central bore 2084. A shoulder 2086 formed by an edge of the central bore 2084 engages the barbs 2082 to retain the spindle 2008 to the internal roller 2030 while still allowing for rotation about the axis and with respect to the neck portion 2048.

Figure 18:
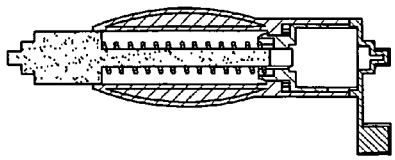
FIG. 18 shows a cross-section view of the dispenser as assembled.

FIG. 18 shows a cross-section view of the dispenser 2000 as assembled.

While the embodiments described herein are intended as an exemplary dispenser (for paper, plastic, foil), it will be appreciated by those skilled in the art that the present invention is not limited for dispensing paper, and may be employed for dispensing any sheet product supplied on rolls or tubes of any length, for household or industrial purposes.

Although preferred embodiments of the different dispensers of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A dispenser for a product oriented on a roll, comprising:
- a first end cap assembly at one end of the dispenser and including a first shaft for hanging the first end cap assembly from a support bracket;
- a second end cap assembly at an opposite end of the dispenser and including a second shaft for hanging the second end cap assembly from the support bracket;
- a spindle rotatably mounted to the first end cap assembly, the spindle including a plurality of bows for engaging an inner surface of the roll and further rotating around an axis extending between the first and second shafts;
- a friction mechanism for providing resistance to rotation of the spindle with respect to the first end cap assembly;
- a flange member radially extending from the first end cap assembly;
- a stop knob mounted to the radially extending flange member and configured to engage the support bracket and inhibit rotation of the first end cap assembly with respect to the first shaft.

2. The dispenser of claim 1, wherein the product comprises toilet paper.

3. The dispenser of claim 1, wherein the first end cap assembly includes an internal roller with a neck portion to engage and support rotation of the spindle.

4. The dispenser of claim 1, wherein the friction mechanism comprises:
- an undulating inner surface associated with the spindle; and
- a bow spring mounted to the first end cap assembly and configured to engage the undulating inner surface of the spindle so as to provide resistance to rotation of the spindle.

5. The dispenser of claim 1 wherein the second end cap assembly is spring loaded.

6. The dispenser of claim 1 wherein the second end cap assembly includes a shaft extending to be slidably received by the first end cap assembly thus allowing the second end cap assembly to be compressed towards the first end cap assembly, and further including a spring biasing the second end cap assembly to be extended away from the first end cap assembly.

7. A dispenser for a product oriented on a roll, comprising:
- a first end assembly of the dispenser including a first shaft for hanging the first end assembly from a support bracket;
- an opposing second end assembly of the dispenser including a second shaft for hanging the second end assembly from the support bracket;
- a spinner for engaging an inner surface of the roll, the spinner being rotatably mounted to the first end assembly so as to rotate about an axis extending between the first and second shafts;
- a friction mechanism for providing resistance to rotation of the spinner about the first end assembly; and
- a stop mechanism associated with the first end assembly which functions to inhibit rotation of the first end assembly with respect to the first shaft.

8. The dispenser of claim 7 wherein the stop mechanism comprises a flange member radially extending from the first end assembly.

9. The dispenser of claim 7 wherein the stop mechanism engages the support bracket and comprises:
- a flange member radially extending from the first end assembly; and stop knob mounted to the radially extending flange member and configured to engage the support bracket.

10. The dispenser of claim 7 wherein the spinner comprises a spindle rotatably mounted to the first end assembly, the spindle including a plurality of bows for engaging an inner surface of the roll.

11. The dispenser of claim 7 wherein the second end assembly is spring loaded.

12. The dispenser of claim 7, wherein the first end assembly comprises:

a first end cap; and an internal roller mounted to the first end cap, the internal roller including a neck portion to engage and support rotation of the spinner.

13. The dispenser of claim 12, wherein the friction mechanism comprises:

an undulating inner surface associated with the spinner; and a bow spring mounted to the internal roller and configured to engage the undulating inner surface of the spinner so as to provide resistance to rotation of the spinner.

14. The dispenser of claim 12, wherein the second end assembly comprises:

a second end cap; and a shaft extending from the second end cap and slidably received by the internal roller thus allowing the second end assembly to be compressed towards the first end assembly.

15. The dispenser of claim 14 further including a spring associated with the shaft and operable to bias the second end assembly to be extended away from the first end assembly.

16. A dispenser for a product oriented on a roll, comprising:

a first end assembly of the dispenser including a first shaft for hanging the first end assembly from a support bracket;

an opposing second end assembly of the dispenser including a second shaft for hanging the second end assembly from the support bracket;

a spindle for receiving and supporting the roll;

means for providing friction resisted rotation of the spindle with respect to the first end assembly; and a stop mechanism associated with the first end assembly which functions to inhibit rotation of the first end assembly with respect to the first shaft.

17. The dispenser of claim 16 wherein the stop mechanism comprises a flange member radially extending from the first end assembly.

18. The dispenser of claim 17 further including a stop knob mounted to a distal end of the radially extending flange member and configured to engage the support bracket.

19. The dispenser of claim 16 wherein the means for providing friction resisted rotation comprises:

a bearing member associated with the first end assembly to engage and support rotation of the spindle about an axis extending between the first and second shafts;

an undulating inner surface associated with the spindle; and a bow spring mounted associated with the first end assembly and configured to engage the undulating inner surface of the spindle so as to provide resistance to rotation of the spindle about the axis.

20. The dispenser of claim 16 wherein the second end assembly is spring loaded and compressible towards the first end assembly in support of installation of the dispenser in the support bracket.

* * * * *